United States Patent [19]

Popkin et al.

[11] 4,128,150

[45] Dec. 5, 1978

[54] EXPANSIBLE CARRYING CASE

[75] Inventors: Jerome L. Popkin, Trenton; Edward F. Litwitz, Lambertville, both of N.J.

[73] Assignee: York Luggage Corporation, Lambertville, N.J.

[21] Appl. No.: 780,444

[22] Filed: Mar. 23, 1977

[51] Int. Cl.[2] ..... A45C 7/00

[52] U.S. Cl. ..... 190/44; 190/21; 150/30

[58] Field of Search ..... 190/44, 21, 22, 45; 150/30; 229/DIG. 3

[56] References Cited

U.S. PATENT DOCUMENTS

| | | | |
|---|---|---|---|
| 920,852 | 5/1909 | Flanagan | 190/44 |
| 1,200,344 | 10/1916 | Hanan | 190/44 |
| 2,331,802 | 10/1943 | Rosenkrantz | 150/30 |
| 2,520,250 | 8/1950 | Meyers | 190/44 |
| 3,523,596 | 8/1970 | Dyke | 190/44 |

FOREIGN PATENT DOCUMENTS

| | | | |
|---|---|---|---|
| 35516 | 12/1965 | Finland | 190/44 |
| 1265395 | 3/1972 | United Kingdom | 190/44 |

*Primary Examiner*—William Price
*Assistant Examiner*—Joseph Man-Fu Moy
*Attorney, Agent, or Firm*—Shapiro and Shapiro

[57] ABSTRACT

Expansible carrying case in which parallel side walls of the case may move apart by virtue of a simple gusset extending continuously along walls of the case that are transverse to the parallel side walls. Expansion of the gusset is limited by rows of stitching along each of the gusset folds. The gusset contracts automatically when the expanding pressure is relieved and remains contracted without requiring auxiliary fasteners.

8 Claims, 3 Drawing Figures

EXPANSIBLE CARRYING CASE

BACKGROUND OF THE INVENTION

This invention is concerned with expansible luggage and more particularly with a carrying case in which a side wall is capable of limited movement away from a parallel side wall.

For years luggage manufacturers have attempted to provide suitcases and other carrying cases with the ability to expand to accommodate bulky contents. Usually the peripheral walls of the carrying case are provided with an expansion joint which permits the principal parallel side walls of the case to move apart under certain circumstances. Most of the expansion joints employed have been too complex and expensive for practicality, involving highly flexible gussets or elastomeric expansion bands that require unwieldy fastening arrangements for retaining the expansion joints in a contracted condition. See, for example, the structures disclosed in U.S. Pat. Nos. 3,443,671; 3,450,237; and 3,523,596 to Dyke; French Pat. No. 1,101,785 (1955); Australian Pat. 2026/26; and Italian Pat. 459,299 (1950).

Other expansion joints have required specially constructed elastomeric bands, as in British Pat. No. 1,265,395. In another approach, shown in U.S. Pat. No. 2,002,878 to Belber, a side wall of an expansible bag is supported upon the peripheral walls by a complex spring arrangement. The handbag of U.S. Pat. No. 2,002,949 to Kenler includes a pleat structure for added bag capacity or for increased strength or for decorative purposes, but the pleat structure is clamped into channels employed in conjunction with a slide fastener and is not constructed to provide the type of expansion required by the present invention.

SUMMARY OF THE INVENTION

It is accordingly an object of the present invention to provide an improved expansible carrying case, such as a suitcase, that is simple, economical, attractive, and easy to manufacture.

A further object of the invention is to provide an improved expansible carrying case having an expansion joint that is hardly noticeable in its normal contracted condition, that expands automatically when the case is packed beyond its normal capacity, that contracts automatically when relieved of the pressure causing expansion, and that does not require fasteners for maintaining its contracted condition.

Another object of the invention is to provide an improved expansible carrying case with an expansion joint expansible within the confines of walls of the case to a limited extent.

Briefly stated, a preferred embodiment of a carrying case constructed in accordance with the invention comprises a pair of substantially parallel side walls, peripheral walls extending transversely between the side walls, and a gusset extending longitudinally along peripheral walls substantially continuously in a plane substantially parallel to the side walls. The gusset has a cross-sectional configuration in a plane substantially perpendicular to the side walls that comprises a pair of outer reverse folds and a pair of inner reverse folds, each fold being defined by first and second legs extending from a junction region. The junction regions of the outer folds are closer together than the junction regions of the inner folds. The legs of each outer fold extend oppositely to the legs of the other, a first leg of each outer fold being connected to a peripheral wall. Each of the inner folds has legs that extend toward the corresponding legs of the other, a first leg of each of the inner folds being connected to the second leg of an associated outer fold, and the second legs of the inner folds being connected to each other. Each fold has means extending between the legs thereof at the leg junction region and extending along the length of the gusset for holding the legs together.

BRIEF DESCRIPTION OF THE DRAWINGS

The invention will be further described in conjunction with the accompanying drawings, which illustrates a preferred and exemplary embodiment, and wherein.

DETAILED DESCRIPTION OF THE PREFERRED EMBODIMENT

Figure 1:
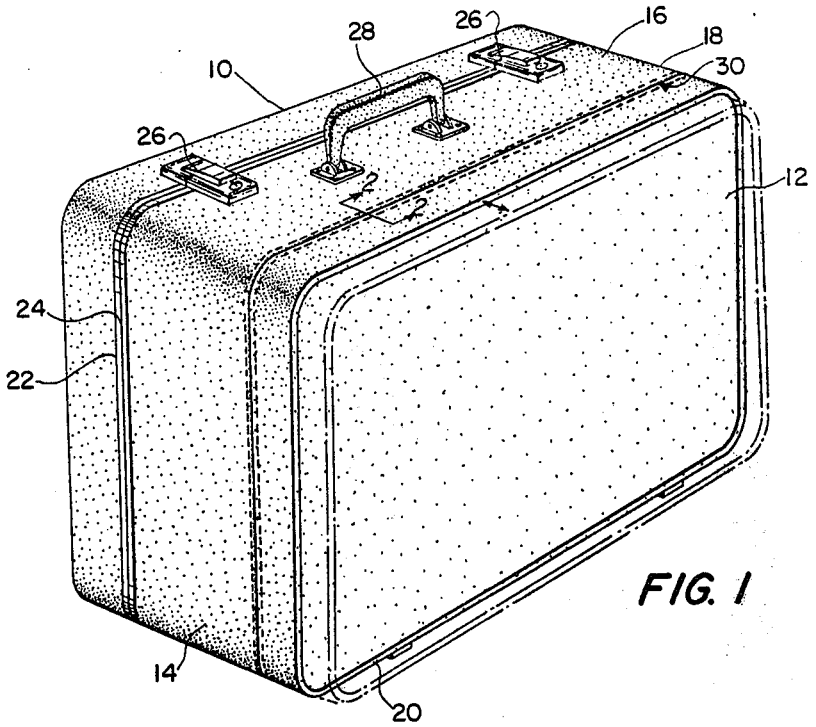
FIG. 1 is a perspective view of a carrying case constructed in accordance with the invention, illustrating in phantom lines the expansion of the case.

In FIG. 1 the invention is shown embodied in a carrying case, such as a "soft-sided" suitcase, having side walls 10 and 12 that are substantially rectangular and parallel. Peripheral walls 14, 16, 18 and 20 extend transversely between the side walls 10 and 12 in the usual manner. The term "peripheral walls" as used in describing the embodiment illustrated is intended to designate what might be called the top wall 16, end walls 14 and 18, and bottom wall 20 of the suitcase oriented as in FIG. 1. The carrying case may comprise a stiff metal frame, including a valance 22 having opposed parts which mate at the opening plane 24 of the case in a well-known manner, and walls of sheet plastic, leather, or other suitable material. Expanded vinyl, canvas-like fabric, and coated fabrics conventionally employed in soft-sided luggage are appropriate. In the illustrative form of the invention, side wall 10 of the carrying case is part of the lid of the case that is conventionally mounted by hinges (not shown) upon wall 20 and that is held closed by means of conventional latches or locks 26 on wall 16. A handle 28 is attached to wall 16 in a well-known manner to permit the case to be lifted. Internal reinforcements or stiffeners (not shown) may also be employed in the usual manner. Except as it is modified by the expansion joint which will be described hereinafter, the carrying case employed in the invention may be conventional. The invention is not limited to suitcases but may be employed in various types of carrying cases, including zipper cases, for example, where it is desired to provide expansion by means of limited relative movement between substantially parallel side walls of the case. In the illustrative example, these side walls constitute the top and bottom walls of the case when the case is oriented for packing or unpacking and are the major or principal walls of the case "halves." The invention is particularly adapted to soft-sided luggage, where the attributes of the invention are especially significant.

In accordance with the invention, the peripheral walls 14–20 of the carrying case are provided with a gusset 30 constituting an expansion joint. The gusset preferably extends longitudinally substantially continuously along all four peripheral walls (except for a seam in wall 20, for example) and lies in a plane substantially parallel to side walls 10 and 12. The gusset construction to be described has certain characteristics which are important to the invention. The gusset is simple, inexpensive, is easily and inconspicuously incorporated in carrying case walls, requires no special fasteners to keep it contracted, expands automatically when outward pressure is applied to a side wall of the case, and contracts automatically when the pressure is relieved.

Figure 2:
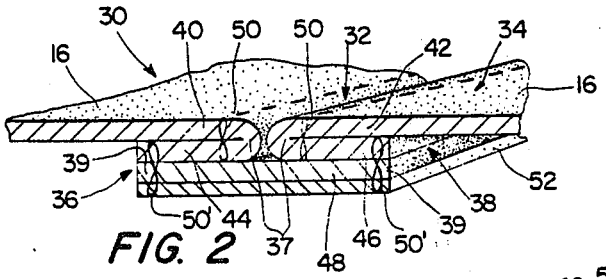
FIG. 2 is a fragmentary sectional perspective view taken along line 2—2 of FIG. 1 and illustrating the expansion joint in contracted condition.
Figure 3:
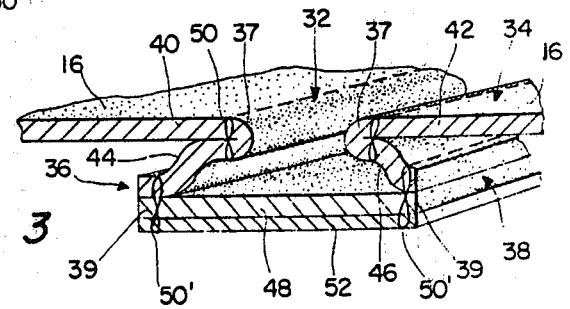
FIG. 3 is a similar view illustrating the expansion joint in expanded condition.

The construction of gusset 30 is illustrated in FIGS. 2 and 3, which for explanatory purposes have been shown as sections through peripheral wall 16, although the construction is essentially the same for each peripheral wall. As shown, the gusset comprises four reverse folds 32–38, which are most easily described with reference to their cross-sectional configuration in a plane perpendicular to side walls 10 and 12. Each fold is defined by first and second legs extending from a junction region. As shown in FIG. 2, the folds are arranged in two pairs -- an outer pair 32, 34 and an inner pair 36, 38. The junction regions 37 of folds 32 and 34 are closer together than the junction regions 39 of folds 36 and 38. The legs of fold 32 extend away from the corresponding legs of fold 34, a first leg 40, 42, of each fold being connected to peripheral wall 16, preferably being integral with the peripheral wall. The legs of fold 36 extend toward the corresponding legs of fold 38, a first leg 44, 46, of each fold merging with (or connected to) a second leg (44, 46) of folds 32 and 34. The second legs, 48, of folds 36 and 38 merge with (or are connected to) each other. In the preferred embodiment, folds 32 and 34 are formed by folding under margins of opposed pieces of the peripheral wall material to provide, in cross-section, U-shaped bights, and folds 36 and 38 are formed by joining a strip (constituting legs 48) to the inner legs of the bights by stitching. As shown in FIG. 2, the legs of each fold are joined by rows of stitching 50, 50' at the junction regions of the folds, the stitching constitutes means for holding the legs together in the normal contracted condition of the gusset and extends longitudinally of the gusset substantially throughout its length. A stiffening backing strip 52 is preferably juxtaposed with legs 48 throughout the length of the gusset and may be attached to legs 48 by stitching 50' and/or by glue.

FIG. 3 illustrates the gusset 30 in its expanded condition, which the gusset assumes when a force is exerted from within the case to move side walls 10 and 12 apart, as when the case is packed more fully than normal. In this condition bights 37 move apart substantially in the plane of peripheral wall 16, transversely to walls 10 and 12, and folds 36 and 38 move inwardly of the confines of the peripheral walls, being free to do so as shown. This expansion of the gusset permits limited movement of side wall 12 of the case away from side wall 10, as indicated by the phantom lines in FIG. 1, so that the effective volume of the case is increased. Expansion of the gusset is limited by the holding means 50, 50' at each fold and by the stiffness of the gusset folds (including backing 52).

In the preferred form, the gusset is made of the same material as the peripheral walls of the case, except for backing 52, which may be formed of cardboard, for example. The backing adds sufficient stiffness to the gusset to maintain legs 48 of the gusset substantially flat as shown. Legs 44 and 46 may be distorted somewhat during expansion of the gusset, as is apparent in FIG. 3, but the stiffness of the gusset material is preferably sufficient in conjunction with the holding means 50, 50' (stitching) to limit the expansion of the gusset to an expanded condition at which legs 44 and 46 form angles of approximately 45° with respect to legs 40, 42, and 48.

When the gusset is contracted as shown in FIGS. 1 and 2, it is hardly noticeable from outside the case. No fasteners are required to maintain the gusset in this condition. Although the gusset material does not stretch in the manner of elastomeric materials employed in the prior art, the resilient resistance of the structure to expansion urges the gusset to return to the contracted condition when the expanding force is relieved.

The gusset is free to expand throughout its length so that the entire side wall 12 may move away from side wall 10 as shown in FIG. 1. The slight inward movement of legs 48 of the gusset which accompanies gusset expansion is not significant when compared with the expansion of the case volume by movement of wall 12 away from wall 10. In this connection, in order to insure proper return of the gusset to its contracted position, the holding means 50, 50' (stitching) at each fold of the gusset is particularly important.

In a typical embodiment of the invention, the walls of a carrying case that is approximately $21\frac{1}{2} \times 13\frac{1}{2} \times 7\frac{1}{2}$ inches are 0.065 inch thick expanded vinyl. The gusset center line is about $1\frac{1}{4}$ inches from wall 12. The rows of stitching 50, 50' are about 3/16 inch from the extremity of the associated junction regions, and the stitches are about 5/32 inch long.The width of backing 52 is about 1 inch.

While a preferred embodiment of the invention has been shown and described, it will be apparent to those skilled in the art that changes can be made in this embodiment without departing from the principles and spirit of the invention, the scope of which is defined in the appended claims. For example, within the broader aspects of the invention the gusset could be omitted from wall 20 if expansion of walls 14–18 were deemed sufficient, but this construction is not preferred. Extra parallel gussets may be provided in the peripheral walls of either case "half" for additional expansion.

The invention claimed is:

1. A carrying case comprising a pair of substantially parallel side walls, peripheral walls extending transversely between said side walls, and a gusset extending longitudinally along peripheral walls of said case in a plane substantially parallel to said side walls, said gusset having a cross-sectional configuration in a plane substantially perpendicular to said side walls that comprises a pair of outer reverse folds and a pair of inner reverse folds, each fold being defined by first and second legs extending from a junction region, the junction regions of the outer folds being closer together than the junction regions of the inner folds, the legs of each outer fold extending oppositely to the legs of the other, a first leg of each outer fold being connected to a peripheral wall, each of the inner folds having legs that extend toward the corresponding legs of the other, a first leg of each of the inner folds being connected to the second leg of an associated outer fold, and the second legs of the inner folds being connected to each other, the junction regions of the inner folds being free to move inwardly when the junction regions of the outer folds are moved apart, thereby expanding the gusset, each fold having holding means extending between the legs thereof at the leg junction region and extending along the length of the gusset for holding the legs together, the holding means in conjunction with the stiffness of the gusset material limiting the expansion of the gusset.

2. A carrying case in accordance with claim 1, wherein said holding means comprises rows of stitching.

3. A carrying case in accordance with claim 2, wherein the outer folds of said gusset have U-shaped bights at their junction regions and are integral with peripheral walls.

4. A carrying case in accordance with claim 3, wherein each of the inner folds of said gusset has its first leg merging with a second leg of an associated outer fold, the second legs of the inner folds merging with each other and being part of a strip attached to the first legs of the inner folds by rows of said stitching.

5. A carrying case in accordance with claim 4, wherein said gusset has a backing strip extending substantially continuously along the gusset and juxtaposed with the first-mentioned strip.

6. A carrying case in accordance with claim 3, wherein said case has four peripheral walls and said gusset extends substantially continuously along all four peripheral walls.

7. A carrying case in accordance with claim 6, wherein said side walls are substantially rectangular principal walls of the case, and wherein one of said side walls is a lid connected to one of said peripheral walls for opening and closing said case.

8. A carrying case in accordance with claim 3, wherein the the expansion of said gusset is limited so that the legs of each fold do not diverge substantially more than about 45°.

* * * * *